US008082601B2

(12) United States Patent
Yang

(10) Patent No.: US 8,082,601 B2
(45) Date of Patent: Dec. 27, 2011

(54) CUSHION PAD AND GLOVE THEREOF

(75) Inventor: Shih-Sheng Yang, Taipei Hsien (TW)

(73) Assignee: Universal Trim Supply Co., Ltd., Taipei Hsien (TW)

( * ) Notice: Subject to any disclaimer, the term of this patent is extended or adjusted under 35 U.S.C. 154(b) by 750 days.

(21) Appl. No.: 12/184,258

(22) Filed: Aug. 1, 2008

(65) Prior Publication Data

US 2009/0307820 A1 Dec. 17, 2009

(30) Foreign Application Priority Data

Jun. 16, 2008 (TW) ..... 97210654 U

(51) Int. Cl.
*A41D 13/015* (2006.01)

(52) U.S. Cl. ..... 2/455; 2/161.1

(58) Field of Classification Search ..... 2/16, 20, 2/21, 455, 161.1, 161.6, DIG. 3, 425, 267, 2/463, 464, 467; 36/29
See application file for complete search history.

(56) References Cited

U.S. PATENT DOCUMENTS

| | | | | |
|---|---|---|---|---|
| 4,730,610 | A * | 3/1988 | Graebe | 128/882 |
| 5,330,249 | A * | 7/1994 | Weber et al. | 297/214 |
| 5,427,577 | A * | 6/1995 | Picchietti et al. | 473/59 |
| 5,518,802 | A * | 5/1996 | Colvin et al. | 428/178 |
| 5,916,664 | A * | 6/1999 | Rudy | 428/178 |
| 6,055,670 | A * | 5/2000 | Parker | 2/161.1 |

* cited by examiner

*Primary Examiner* — Katherine Moran
(74) *Attorney, Agent, or Firm* — Leong C. Lei

(57) ABSTRACT

The cushion pad according to the present invention contains a ciliated member and a base member, both made of a flexible plastic material and having a same planar shape. The ciliated member has a large number of hollow protrusions on a front side. The base member is attached to a back side of the ciliated member by high-frequency fusing their circumferences together to form a rim belt with two openings. A pressure release valve is plugged in one opening, and a one-way valve and a pumping device is plugged in the other opening. When air is pumped into a closed space among the ciliated member, the base member, and the rim belt by the pumping device, the cushion pad could offer significantly superior shock absorption.

14 Claims, 9 Drawing Sheets

CUSHION PAD AND GLOVE THEREOF

TECHNICAL FIELD OF THE INVENTION

The present invention generally relates to gloves, and more particularly to an air-filled cushion pad and a glove incorporating the cushion pad for shock absorption.

DESCRIPTION OF THE PRIOR ART

A batting glove, usually made of cloth or leather, is commonly worn by a baseball batter to prevent the bat from slipping out of the sweaty palm. In addition to the improved gripping, the batting glove could also provide a certain degree of shock absorption when hitting a ball.

However, the degree of shock absorption offered by a conventional batting glove is far from satisfactory. When the bat directly hits a ball of high speed, the counterforce is totally received by the batter's fingers and palm, often directly affecting the performance of the batter.

SUMMARY OF THE INVENTION

The primary purpose of the present invention is to provide a novel cushion pad and a glove incorporating the cushion pad. A main purpose of the present invention is that the cushion pad has a simple, easy to manufacture, and superior shock absorbing structure.

The cushion pad according to the present invention contains a ciliated member and a base member, both made of a flexible plastic material and having a same planar shape. The ciliated member has a large number of hollow protrusions on a front side. The base member is attached to a back side of the ciliated member by high-frequency fusing their circumferences together to form a rim belt with two openings. A pressure release valve is plugged in one opening, and a one-way valve and a pumping device is plugged in the other opening. When air is pumped into a closed space among the ciliated member, the base member, and the rim belt by the pumping device, the cushion pad could offer significantly superior shock absorption.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
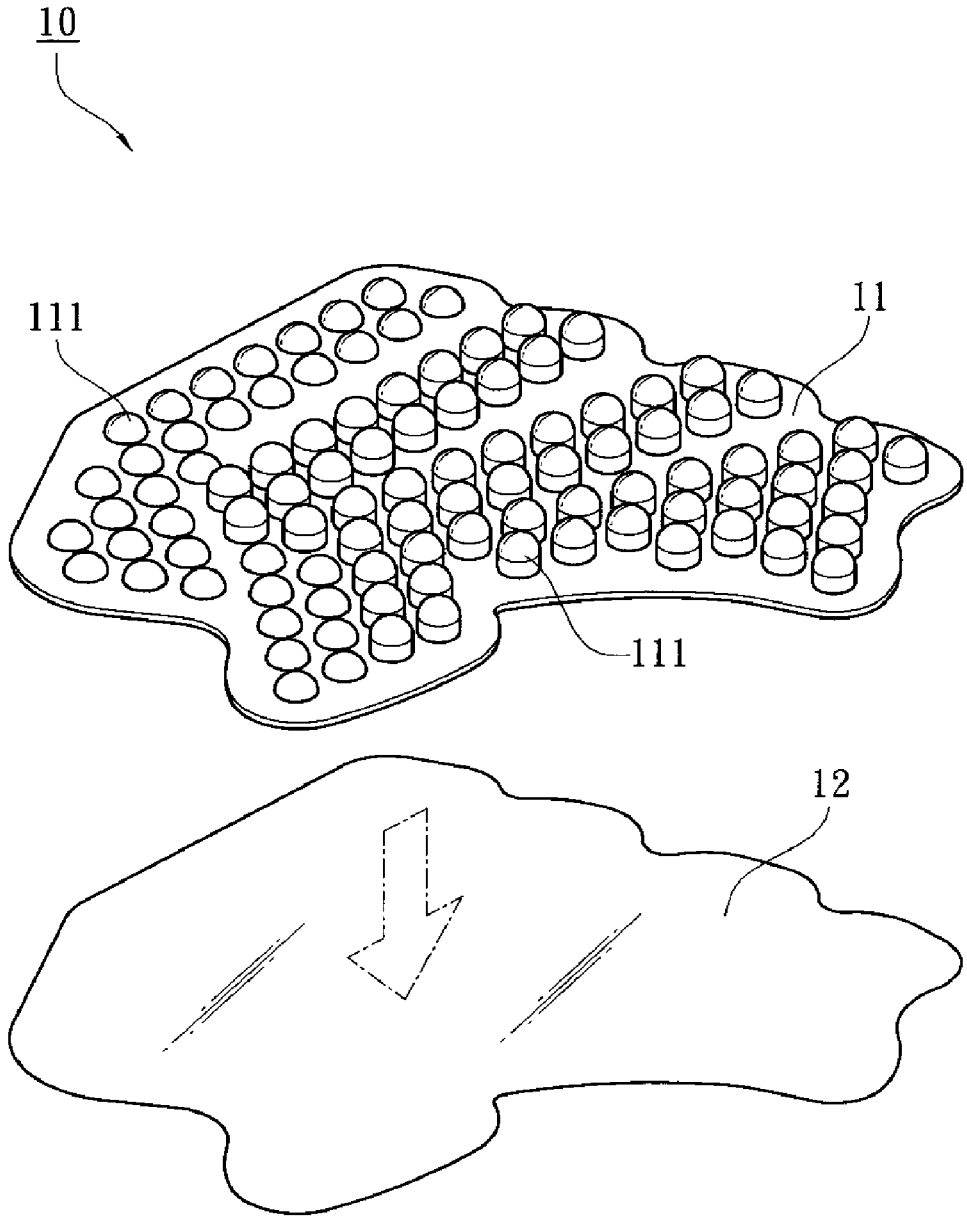
FIG. 1 is an exploded diagram showing the various components of a cushion pad according to an embodiment of the present invention.
Figure 2:
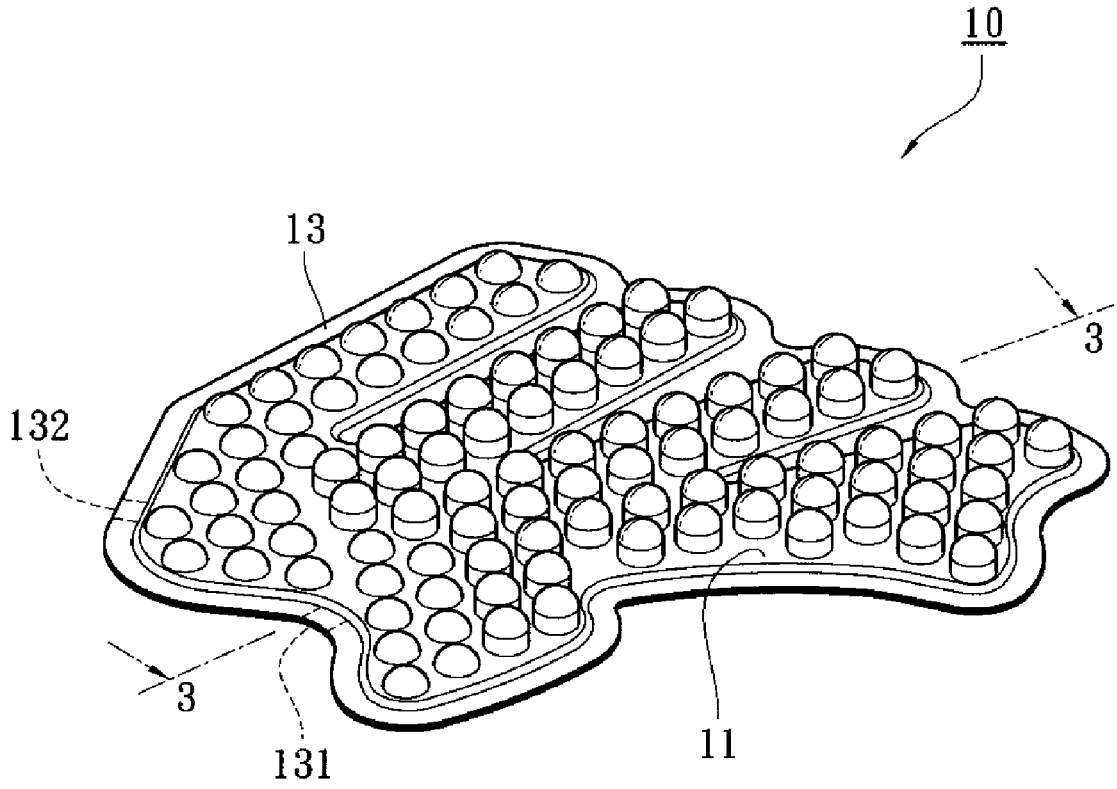
FIG. 2 is a perspective diagram showing the cushion pad after its assembly.
Figure 3:
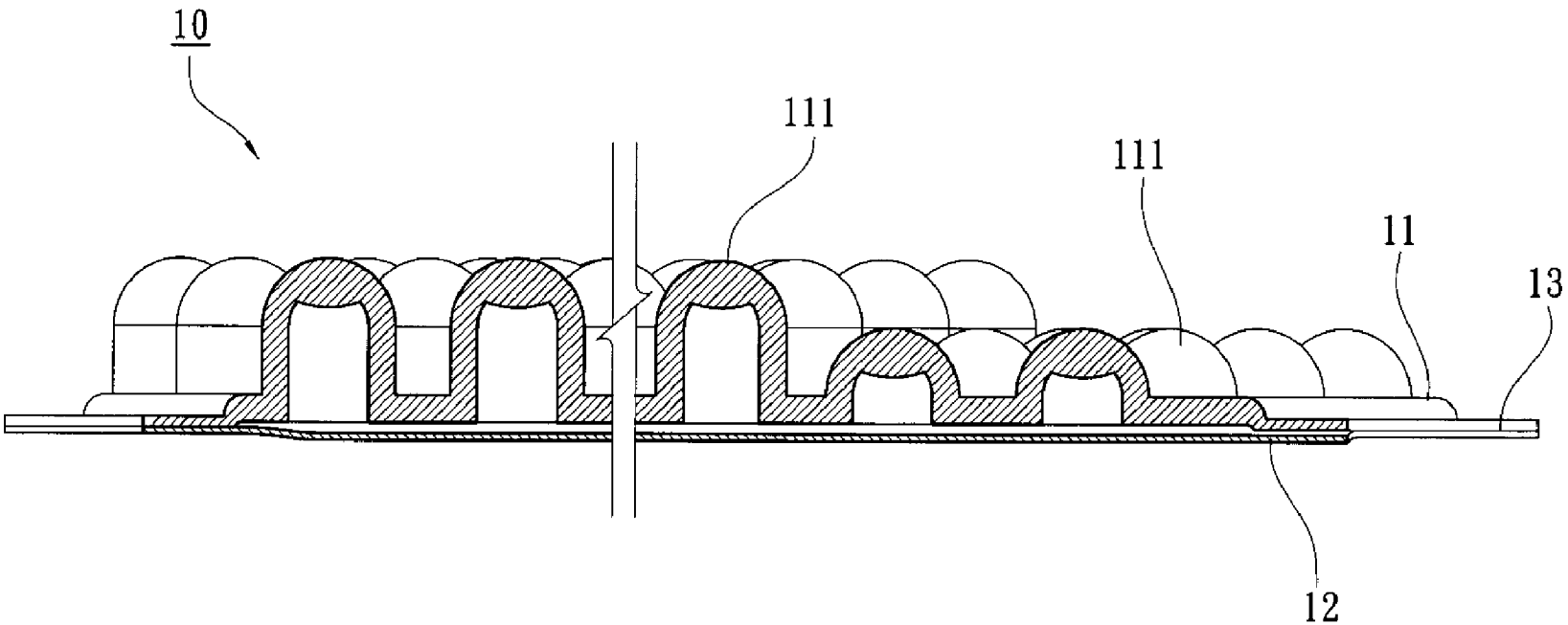
FIG. 3 is a sectional diagram of the cushion pad of FIG. 2 along the 3-3 line.

As shown in FIGS. 1 to 3, a cushion pad 10 according to an embodiment of the present invention contains a flat ciliated member 11 and a flat base member 12, both having a same planar shape and both made of a flexible plastic material. On a front side of the ciliated member 11, there are a large number of single-axis cylindrical protrusions 111 of various heights. In the present embodiment, the protrusions are of two different heights. In alternative embodiments, the heights of protrusions 111 could be configured and arranged so that the protrusions 111 have continuously increasing and/or decreasing heights and jointly constitute a slant surface or a convex surface. These protrusions 111 are all hollow and open to a back side of the ciliated member 11. A number of solid cylinders (not shown) which are shorter than the protrusions 111 are also provided on the front side of the ciliated member 11, among the protrusions 111 and/or concentrated in one or more areas.

The base member 12 is attached to the back side of the ciliated member 11 and their circumferences are high-frequency fused together to form a rim belt 13 surrounding the assembly of the base member 12 and the ciliated member 11. Along the rim belt 13, a first opening 131 and a second opening 132 are reserved (i.e., the base member 12 and the ciliated member 11 there are not fused together).

Figure 4:
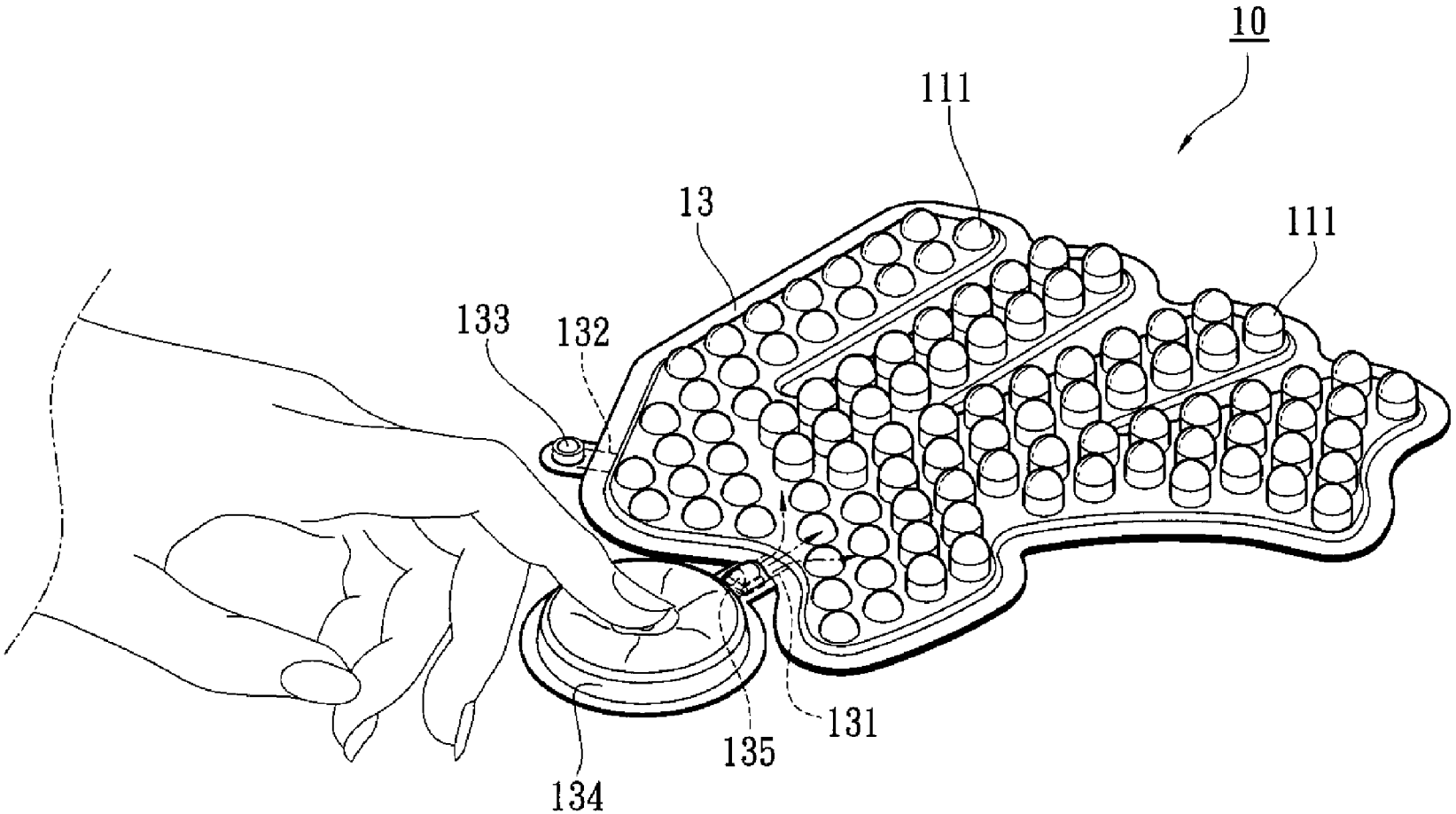
FIG. 4 shows how air is pumped into the cushion pad of FIG. 2.

As shown in FIG. 4, a pressure release valve 133 is plugged into the second opening 132. On the other hand, a one-way valve 135 connecting to a pumping device 134 is plugged into the first opening 131. Air could be pumped into a space surrounded by the base member 12, the ciliated member 11, and the rim belt 13 by the pumping device 134. The pressure release valve 133 is normally closed so that, together with the one-way valve 135, air pumped into the space cannot escape.

Figure 5:
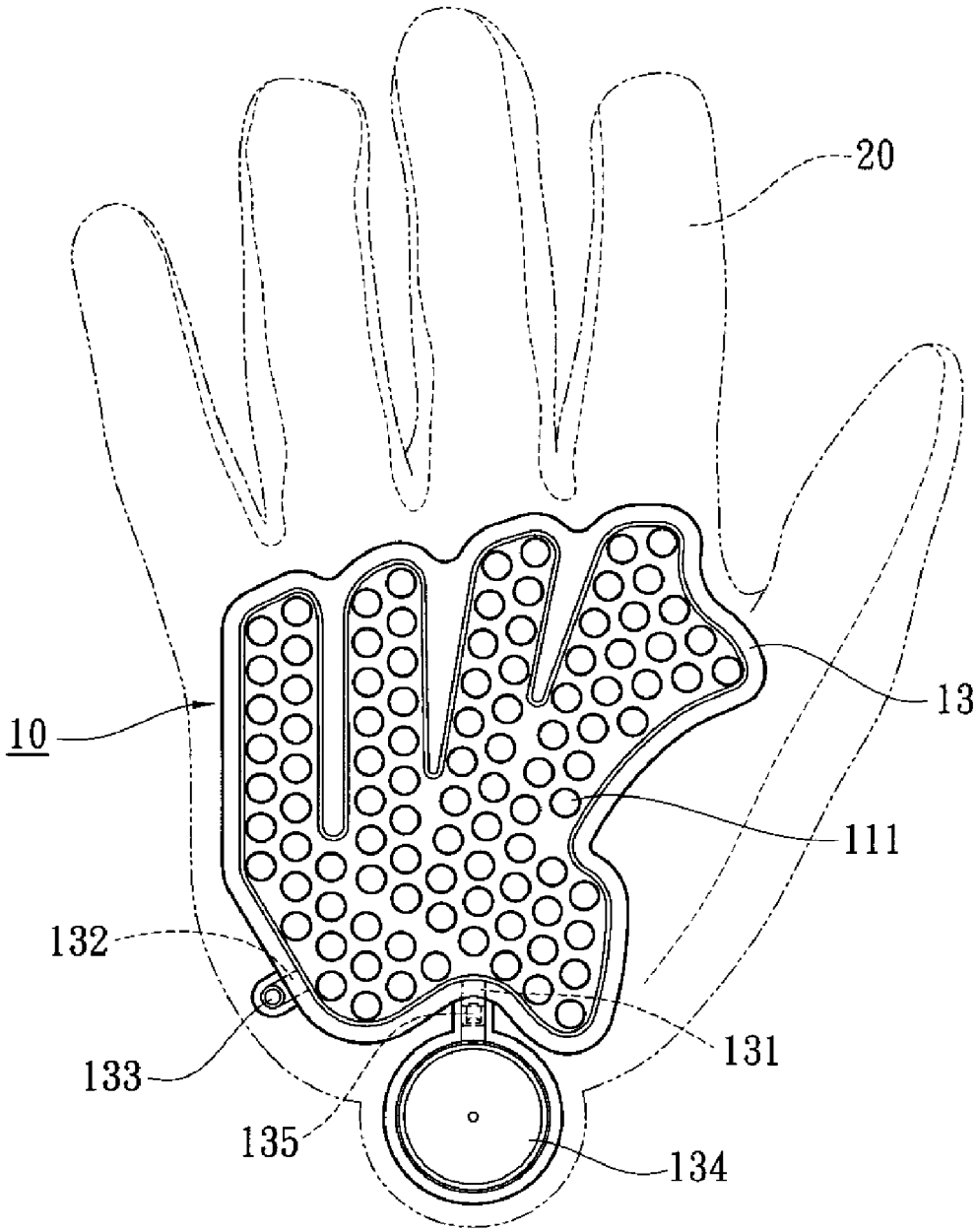
FIG. 5 shows an application of the cushion pad of FIG. 2 to a batting glove.

FIG. 5 shows an application of the cushion pad 10 to a batting glove 20 commonly worn by a baseball batter. The cushion pad 10 is attached to a palm area of the batting glove 20 by applying adhesive or stitches to the rim belt 13 so that the base member 12 is flatly joined to the batting glove 20. As illustrated, the pumping device 134 is located adjacent to the wrist of the batting glove 20. By pumping air into the cushion pad 10, the batting glove 20 could provide superior shock absorption when hitting the ball. In an alternative embodiment, the cushion pad 10 is attached or extended to the finger areas of the batting glove 20.

Figure 6C:
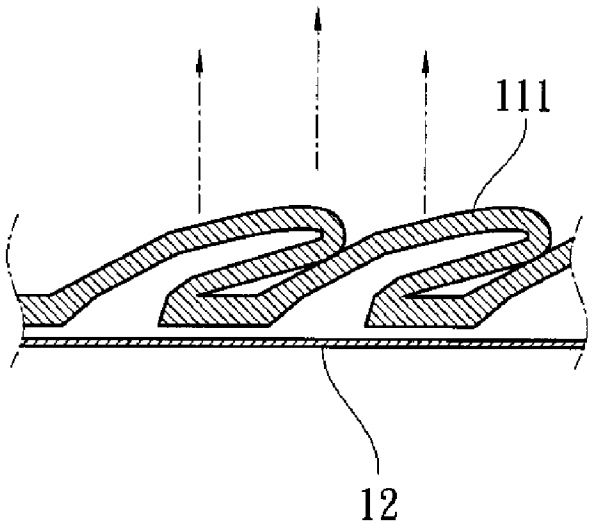
FIGS. 6A to 6C show the various manners shock is absorbed by the cushion pad of FIG. 2.
Figure 6B:
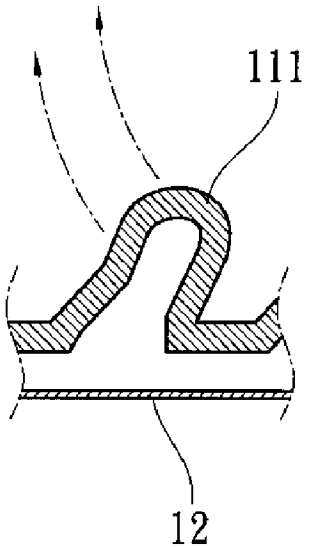
Figure 6A:
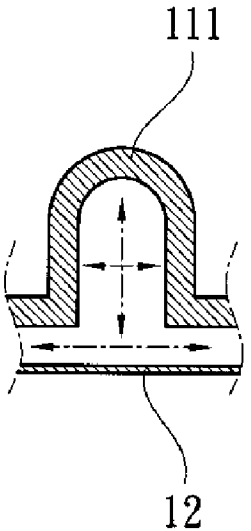

The amount of air pumped into the cushion pad 10 is determined by the user when he or she operates the pumping device 134. As shown in FIG. 6A, the air inside each protrusion 111 exerts a uniform pressure on the inner wall of the protrusion 111, thereby providing excellent protection to the glove wearer. In addition to the protection offered by the pumped air, as shown in FIG. 6B, the deformation and the thickness of the flexible plastic material making the protrusions 111 also offer a second level of protection. Further more, as shown in FIG. 6C where the protrusions 111 are under extreme impact, the dense arrangement of the protrusions 111 causes the protrusions 111 to overlap on their neighbors, thereby providing a third level of protection.

Figure 7:
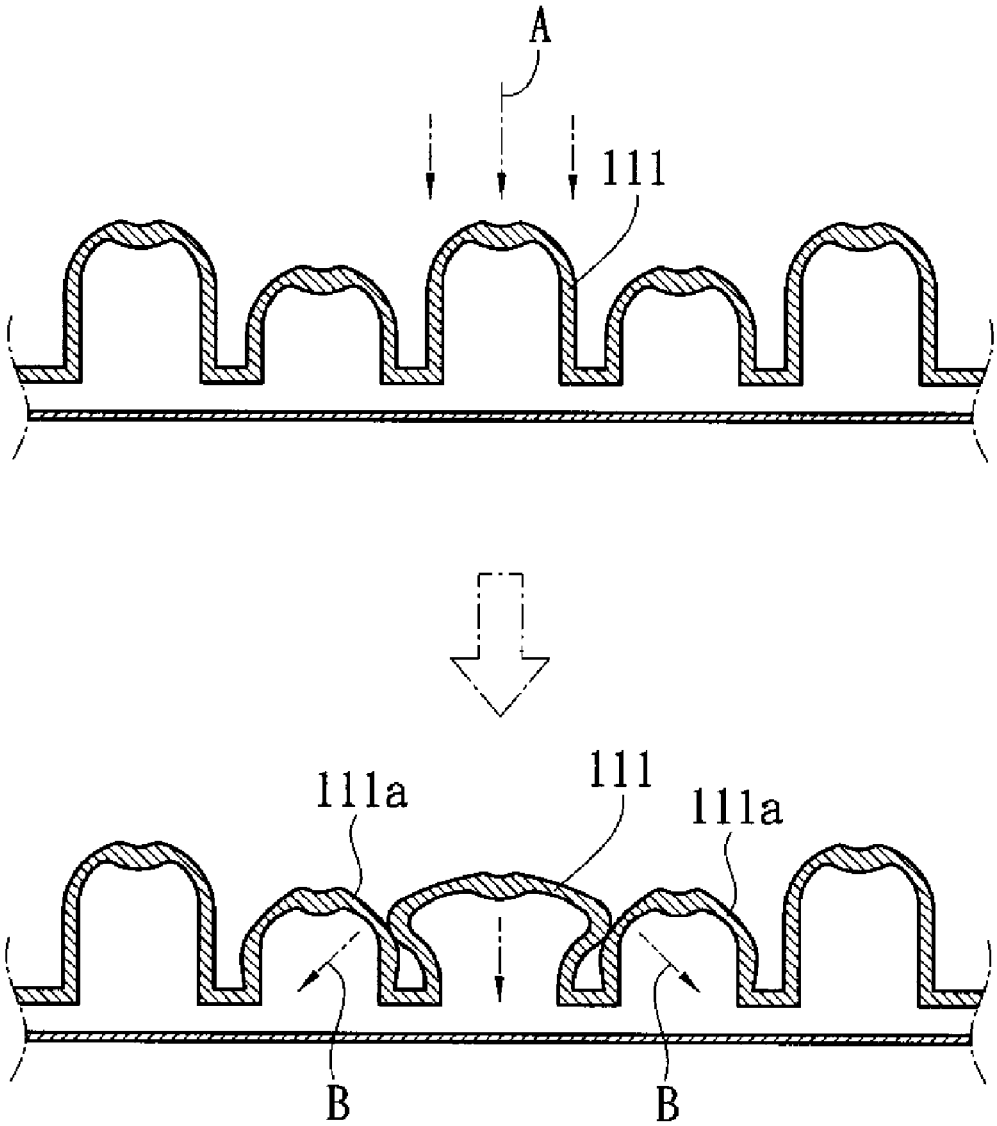
FIG. 7 shows how pressure is distributed to neighboring protrusions of the cushion pad of FIG. 2.

FIG. 7 shows another scenario of the absorption of external impact. As illustrated, when a protrusion 111 is under an external pressure A, a portion of the pressure A is absorbed by the air inside the protrusion 111. Then, as the remaining pressure continues to squeeze the protrusion 111, the deformation of the protrusion 111 turns and distributes the remaining pressure into separate pressures B that are received and absorbed by adjacent protrusions 111*a*. Please note that the distance among the protrusions 111 and the wall thickness of each protrusion 111 do not have to be uniform and identical. In some embodiment where external impact is expected to come from a specific direction, the protrusions 111 could have indentations on their surfaces so that they tend to slant to that direction to enhance shock absorption in that specific direction.

Figure 8:
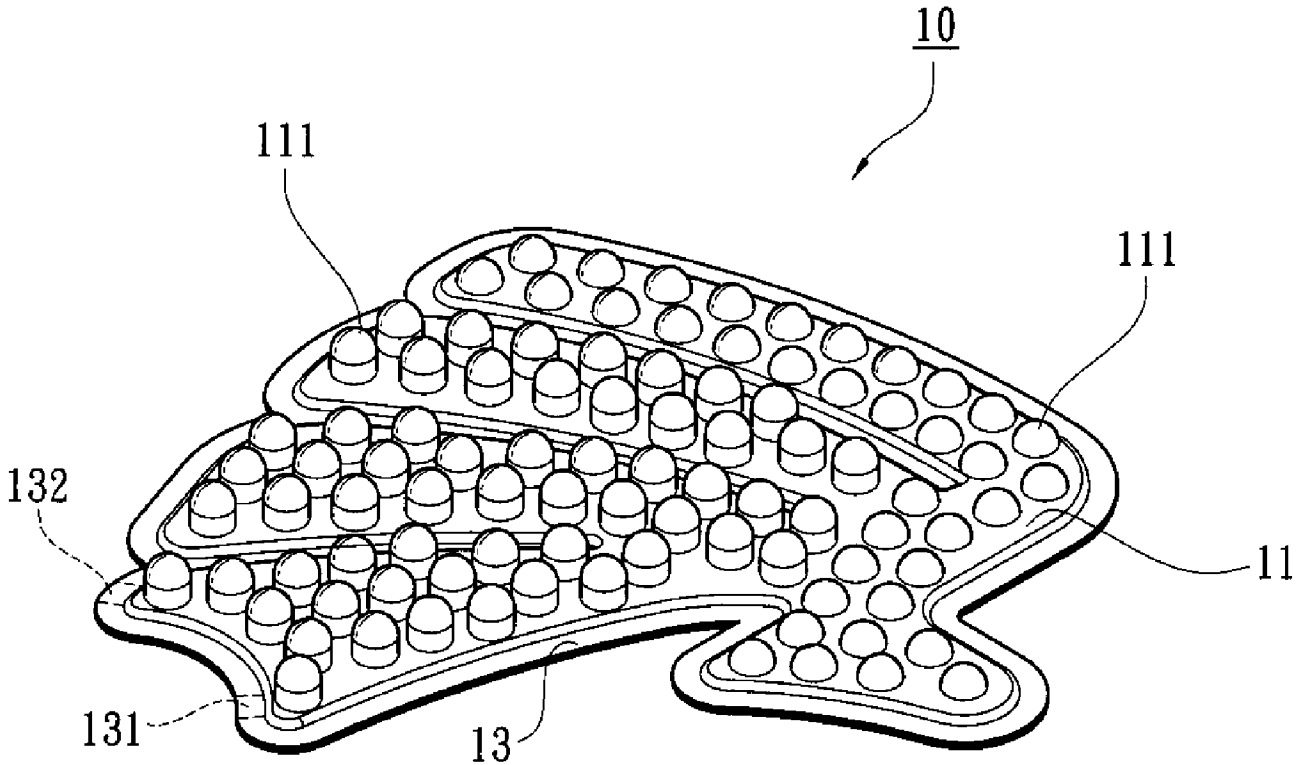
FIG. 8 is a perspective diagram showing a cushion pad according to another embodiment of the present invention.
Figure 9:
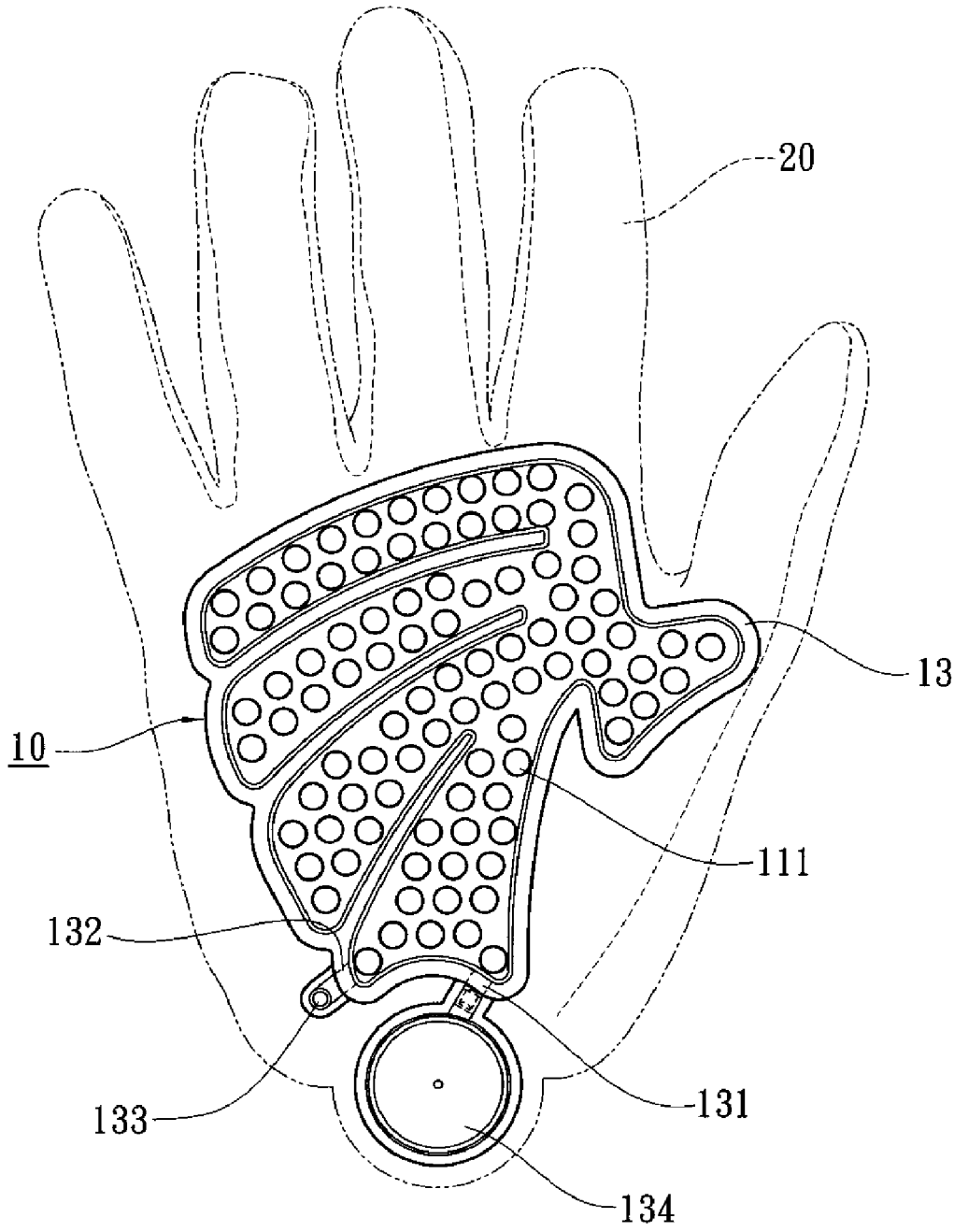
FIG. 9 shows an application of the cushion pad of FIG. 8 to a batting glove.

FIGS. 8 and 9 show another embodiment of the present invention, which is different from the previous embodiment in that the first and second openings 131 and 132 of the rim belt 13 are located differently; the pressure release valve 133 is plugged into the second opening 132; the one-way valve 135 and the pumping device 134 is connected to the first opening 131; and the cushion pad 10 is joined to the batting glove 20 laterally.

According to the present invention, by a very simple structure, the cushion pad could be designed and manufactured to fit different application requirements. As to a glove that incorporates the cushion pad, it could provide superior comfort, improved grip, and shock absorption when hitting the ball.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cushion pad, comprising:

a flat ciliated member having a plurality of single-axis protrusions on a front side of said ciliated member;

a flat base member having a same planar shape of said ciliated member, said base and a back side of said ciliated members having their circumferences fixedly joined together to form a rim belt with a first opening and a second opening;

a pressure release valve plugged in said first opening; and a pumping device plugged in said second opening;

wherein a closed space is formed between said base member, said ciliated member, and said rim belt; air is pumped into said closed space by said pumping device for shock absorption; and said protrusions have indentations on their surfaces.

2. The cushion pad according to claim 1, wherein said protrusions have a hollow cylindrical shape.

3. The cushion pad according to claim 1, wherein said protrusions have at least two different heights.

4. The cushion pad according to claim 1, wherein said protrusions have continuously varying heights and jointly constitute a slant surface.

5. The cushion pad according to claim 1, wherein said protrusions have continuously varying heights and jointly constitute a convex surface.

6. The cushion pad according to claim 1, wherein said protrusions have various distances.

7. A glove having a glove body and a cushion pad attached to said glove body, said cushion pad comprising:

a flat ciliated member having a plurality of protrusions on a front side of said ciliated member;

a flat base member having a same planar shape of said ciliated member, said base and a back side of said ciliated members having their circumferences fixedly joined together to form a rim belt with a first opening and a second opening;

a pressure release valve plugged in said first opening; and a pumping device plugged in said second opening;

wherein a closed space is formed between said base member, said ciliated member, and said rim belt; air is pumped into said closed space by said pumping device for shock absorption; and said protrusions have indentations on their surfaces.

8. The glove according to claim 7, wherein said cushion pad is attached to a palm area of said glove body.

9. The glove according to claim 7, wherein said cushion pad is attached to finger areas of said glove body.

10. The glove according to claim 7, wherein said protrusions have a hollow cylindrical shape.

11. The glove according to claim 7, wherein said protrusions have at least two different heights.

12. The glove according to claim 7, wherein said protrusions have continuously varying heights and jointly constitute a slant surface.

13. The glove according to claim 7, wherein said protrusions have continuously varying heights and jointly constitute a convex surface.

14. The glove according to claim 7, wherein said protrusions have various distances.

* * * * *